US007170735B2

(12) United States Patent
Diskin

(10) Patent No.: US 7,170,735 B2
(45) Date of Patent: Jan. 30, 2007

(54) ELECTROSTATIC DISCHARGE SYSTEM

(76) Inventor: Elon Diskin, 8 Rabbi Akiva Street, Jerusalem (IL) 94582

( * ) Notice: Subject to any disclaimer, the term of this patent is extended or adjusted under 35 U.S.C. 154(b) by 219 days.

(21) Appl. No.: 10/725,964

(22) Filed: Dec. 1, 2003

(65) Prior Publication Data

US 2005/0002145 A1 Jan. 6, 2005

(30) Foreign Application Priority Data

Jun. 30, 2003 (IL) ..... 156712

(51) Int. Cl.
*H01H 47/00* (2006.01)

(52) U.S. Cl. ..... 361/220

(58) Field of Classification Search ..... 361/220
See application file for complete search history.

(56) References Cited

U.S. PATENT DOCUMENTS

| | | | | |
|---|---|---|---|---|
| 1,709,779 A | | 4/1929 | Crothers | |
| 2,164,076 A | | 6/1939 | Osgood | |
| 2,280,327 A | * | 4/1942 | Ware | 361/219 |
| 2,502,496 A | | 4/1950 | Wickman | |
| 3,148,833 A | * | 9/1964 | Wilson et al. | 239/150 |

FOREIGN PATENT DOCUMENTS

| | | |
|---|---|---|
| FR | 1 253 307 | 2/1961 |
| FR | 2 539 362 | 7/1984 |

* cited by examiner

*Primary Examiner*—Burton S. Mullins
*Assistant Examiner*—Lucy Thomas
(74) *Attorney, Agent, or Firm*—Martin Fleit; Paul D. Bianco; Fleit, Kain, Gibbons, Gutman, Bongini & Bianco P.L.

(57) ABSTRACT

An electrostatic discharge system for a road vehicle including an electrically conducting conductor element in electrical contact with an electrically conducting part of the vehicle body, an actuator mountable to the vehicle and adapted for selectively and reversibly moving the conductor element between a deployed position and a retracted position, and a controller operatively connected to the actuator and to a user interface and adapted for controlling operation of the actuator responsive to an interaction with the user interface, wherein in the deployed position the conductor element is in contact with the ground such as to provide an electrical pathway for electric charge from the electrically conducting part of the vehicle body to the ground, and wherein in the retracted position the conductor element is distanced from the ground such as to interrupt the electrical pathway.

20 Claims, 8 Drawing Sheets

ELECTROSTATIC DISCHARGE SYSTEM

BACKGROUND OF INVENTION

1. Field of the Invention

The present invention relates generally to the dispersal of electrostatic charge from a vehicle. In particular, the present invention is concerned with providing a discharge system that enables the user, typically the vehicle driver, to safely discharge the electrostatic charge on the vehicle when desired or at predetermined situations such as, for example, when the vehicle comes to a permanent stop.

2. Prior Art

Electrostatic shock from a vehicle body is a well known phenomenon. Static electricity may accumulate on parts of a vehicle's body, and also on the human occupants thereof, for a variety of reasons including by reason of friction where the exhaust gases leave the exhaust pipe or friction between the occupants' clothing and the upholstery. It is not uncommon for such occupants to receive an electric shock when alighting the vehicle, as their feet touch the ground. Typically, a spark discharge forms between the vehicle body and the occupant, when they are in close proximity and the occupant is now standing on the ground. The severity of the shock varies, and depends on local weather conditions as well as on the type of materials worn by the occupant. In some rare cases, the discharge may create a fire or explosion hazard, and lead to partial or total destruction of the vehicle and injury or death to the occupants and well as bystanders.

One commonly known attempt at solving this problem is by providing electrical communication between the vehicle body and the ground, by means of a strap or chain that is connected to an electrically conducting part of the vehicle and that hangs therefrom to form permanent contact with the ground. Such straps or chains provide a discharge path from the vehicle to the ground for removing any electric charge buildup of the body with respect to the ground potential.

However, such straps and chains are quickly worn out or damaged by the constant contact with the ground as the vehicle travels at high speed over a range of terrains, which requires the straps or chains to be regularly monitored and replaced. Furthermore, the straps and chains are liable to cause loose materials on the roads to be ejected in a predominantly rearwards direction, thus potentially causing damage to a trailing vehicle.

An aim of the present invention is to provide a system that substantially overcomes the aforementioned disadvantages of prior art electrostatic discharge systems.

It is another aim of the present invention to provide an improved electrostatic discharge system that is deployable only when the vehicle has come to rest.

It is another aim of the present invention to provide an improved electrostatic discharge system that is deployable responsive to a command from the driver.

It is another aim of the present invention to provide an improved electrostatic discharge system that is relatively simple to install and that is relatively inexpensive to manufacture.

It is another aim of the present invention to such an improved system which is readily retrofittable to existing vehicles.

Other purposes and advantages of the invention will appear as the description proceeds.

SUMMARY OF THE INVENTION

The present invention relates to an electrostatic discharge system for a vehicle comprising: at least one electrically conducting conductor element in electrical contact with an electrically conducting part of the vehiclebody;

a. actuation means mountable to said vehicle, said actuation means b. adapted for selectively and reversibly moving said conductor element c. between a deployed position and a retracted position, wherein in said d. deployed position said conductor element is in contact with the ground e. such as to provide an electrical pathway for electric charge from said f. electrically conducting part of the vehicle body to the ground, and wherein g. in said retracted position said conductor element is distanced from the h. ground such as to interrupt said electrical pathway; and i. control means operatively connected to said actuation means and to a user interface, adapted for controlling operation of said actuation means responsive to an interaction with said user interface, typically by the driver of the vehicle.

Preferably, the actuating means comprises a bracket for mounting said actuating means to the vehicle, and a strut member having a free end near which said conductor element is pivotably mounted for rotation with respect thereto via a pivot, said conductor element having a free end adapted for contacting the ground when in the said deployed position.

The actuation means typically comprises a driving means operatively connected to said conductor element and controlled by said control means for enabling deployment and retraction of said conductor element.

In the first embodiment, the driving means is in the form of a bracket mounted on said conductor element, and said control means is in the form of a clamp that is operatively connected to said user interface, said user interface being adapted to provide a reciprocating motion correlated to deploying and retracting said conductor element, said control means being connected to said driving means via a mechanical linkage, such that a translation of said control means provided by the user interface causes a rotational motion of said driving means, which in turn drives the free end of said conductor element to said deployed or retracted positions. Optionally, the conducting element is adapted for enabling the said driving means to be mounted thereonto in at least one of a plurality of positions with respect thereto.

In a second and third embodiments, the driving means is in the form of an extension of said conductor element on the opposite side of said pivot, and said control means is in the form of a clamp that is operatively connected to said user interface, said user interface being adapted to provide a reciprocating motion correlated to deploying and retracting said conductor element, said control means being connected to said driving means via a mechanical linkage, such that a translation of said control means provided by the user interface causes a rotational motion of said driving means, which in turn drives the free end of said conductor element to said deployed or retracted positions.

In a fourth embodiment, the driving means comprises a rack and pinion arrangement, comprising a rack component joined to said clamp and a complementary pinion component joined to said conductor element coaxial with said pivot.

In the second and third embodiments in particular, the system may further comprise a restoring spring mounted to said extension and said strut member, such that said spring stores potential energy when said conductor element is moved from said deployed position to said retracted position or from said retracted position to said deployed position. The spring may store potential energy by compression thereof between said extension and said strut member, or alternatively by being elastically stretched between said extension and said strut member.

Typically, the actuating means are mountable to an underside of said vehicle; the actuating means are made from an electrical conducting material; and/or, the system further comprises an electrical conductor fixed to said electrically conducting part of said vehicle and to said conductor element.

Optionally, the conductor element comprises an upper part pivotably mounted to said bracket and a lower part comprising said free end. The lower part may be telescopically slidable with respect to said upper part for adjusting a longitudinal length of said conductor element. Optionally, the free end is in spherical form, and the lower part is in substantially rectilinear form or in substantially helical form.

Preferably, the user interface comprises the handbrake system of the vehicle, and said control means comprise a suitable clamp for clamping a brake cable associated with said handbrake system such as to operate said actuation means to selectively deploy or retract said conductor element according to whether said handbrake is in the on or off position, respectively, such as to reciprocably displace the associated brake cable from one position to another position, responsive to an interaction by a user (typically the driver) with said handbrake system.

In a fifth embodiment, the system further comprises a suitable arrangement of pulleys for displacing the brake cable of the vehicle in a direction away from the chassis thereof.

Typically, the system is in the form of a device that is mountable to a chassis of said vehicle and that may be operatively connected to a handbrake cable of said vehicle, and the device is preferably retrofittable to a road vehicle.

In a sixth embodiment and in a seventh embodiment, said actuation means may be powered by suitable power means including any one of pneumatic, electrical or hydraulic power means.

Particularly for the seventh embodiment, the actuator means comprises an electrical motor, typically an electrical stepper motor. The motor comprises a shaft connected to said conductor element and wherein said shaft is capable of selectively and reversibly rotating the shaft through a predetermined arc $\alpha$, from said retracted position said deployed position, and back to the retracted position. The motor is preferably connected to a suitable electrical power source and said user interface via a suitable circuit.

Optionally, said interface comprises the brake light circuit of said vehicle, wherein selective completion or braking of said brake light circuit, responsive to an interaction by user comprising actuation or release of the brake, reversibly deploys or retracts said conductor element.

Additionally or alternatively, said interface comprises the parking light circuit of said vehicle, wherein selective completion or braking of said parking light circuit, responsive to an interaction by user comprising actuation or release of the parking mode of the gearbox of the vehicle, reversibly deploys or retracts said conductor element.

Additionally or alternatively, said interface comprises a suitable switch actuable by a user in the vehicle, wherein selective completion or braking of a switch light circuit of said switch, responsive to an interaction by user comprising actuation or inactivation of said switch, reversibly deploys or retracts said conductor element.

Preferably, the actuating means of the sixth or seventh embodiments comprises a suitable housing mountable to an underside of said vehicle, and further comprises an electrical conductor fixed to said electrically conducting part of said vehicle and to said conductor element. Optionally, the conductor element comprises an upper part pivotably mounted to said shaft and a lower part comprising said free end. Optionally, said lower part is telescopically slidable with respect to said upper part for adjusting a longitudinal length of said conductor element. Optionally, said free end is in spherical form and said lower part is in substantially rectilinear form and/or in substantially helical form.

Optionally, the user interface comprises a suitable computer programmed to provide suitable deployment and retracting signals to said control means according to predetermined conditions, and wherein said control means comprise suitable power means for powering said driving means according to signals received from said computer. The system may further comprise a motion sensor operatively connected to said computer, and wherein said computer is programmed to provide appropriate deployment signal to said actuation means when said motion sensors sense an absence of motion by the vehicle.

The present invention also relates to a method for discharging static electricity from a vehicle comprising:

(a) providing a selectively retractable and deployable electrical conductor in electrical contact with the vehicle body;

(b) when it is desired to provide a ground path for the vehicle, deploying the conductor such as to contact the ground;

(c) when it is desired to stop such contact, retracting the conductor.

Preferably, the step of providing a ground path for the vehicle is advantageously associated with operation of the handbrake system of the vehicle.

Thus, the present invention is directed to providing, an improved system for discharging electrostatic accumulation from a vehicle body when desired by an occupant, typically the driver. In particular, the system may be advantageously configured to operate when the vehicle has come to a complete stop. This is generally correlated with the most likely moment for generating potentially dangerous spark discharges, which is typically when the occupants leave the vehicle and touch the body thereof. Furthermore, discharge is usually complete well before the occupants leave the vehicle.

BRIEF DESCRIPTION OF THE FIGURES

FIG. 2(*b*) and FIG. 2(*c*) illustrate alternative configurations for the conductor element of the embodiment of FIGS. 1(*a*) and 1(*b*)

DETAILED DESCRIPTION OF THE PREFERRED EMBODIMENTS OF THE INVENTION

Figure 1A:
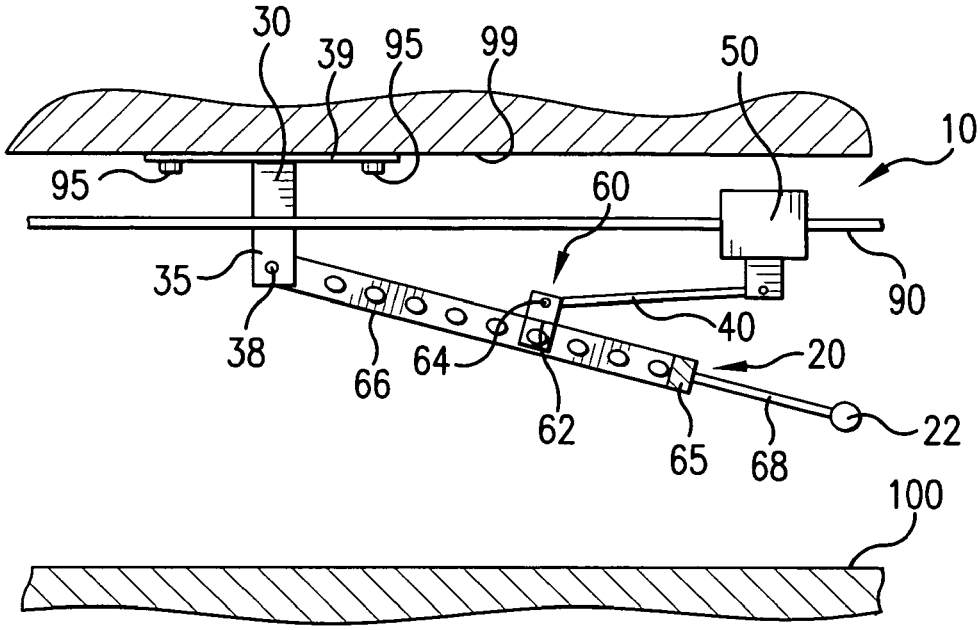
FIG. 1(*a*) and FIG. 1(*b*) illustrate schematically a first embodiment of the present invention in the retracted and deployed position, respectively.

The present invention is defined by the claims, the contents of which are to be read as included within the disclosure of the specification, and will now be described by way of example with reference to the accompanying Figures.

The present invention relates to an electrostatic discharge system for a vehicle, of the type that comprises a conductor that provides an electrical pathway for electric charge from an electrically conducting part of the vehicle body to the ground. The improvement of the system in the present invention is characterised in that, rather than being configured to permanently touch the ground, means are provided for selectively retracting the conductor into a stowed or retracted position when not required, and for deploying the conductor in a ground-contacting position when it is desired by the user.

The term "vehicle" refers herein to all manner of road vehicle, including but not limited to, cars, motorcycles, SUV's, buses, trucks, vans, trailers, campers, transporters, and so on, military vehicles such as tanks, personnel carriers and the like, earth moving equipment such as tractors, bulldozers and the like, and so on.

The present invention is particularly directed to an electrostatic discharge system for a vehicle that is simple to install and is thus readily incorporated into new vehicles or refittable/retrofitable to any number of existing motor vehicles. In the first through fifth embodiments described herein, the electrostatic discharge system is adapted to deploy according to a specific predetermined condition, that of the vehicle coming to a complete and permanent rest, in which the handbrake is actuated. This predetermined condition is of particular interest, since, as has been discussed above, it is usually associated with occupants leaving the vehicle and making contact with the vehicle body, which is potentially the most hazardous time for electrostatic discharging between the occupants and the vehicle body. At the same time, the system is retracted when the vehicle is moving and thus prevents wear and other damage which would otherwise occur due to high speed contact with the ground. In these embodiments, the system of the present invention is in the form of a device that comprises actuating means for selectively stowing or deploying an electrically conducting member, wherein the actuating means are operatively connected to or otherwise associated with the handbrake system of the vehicle, particularly in a mechanical manner. These embodiments are easily mountable onto vehicles that have exposed brake cables, such as many older models of cars, and many trucks and other vehicles. In the sixth and seventh embodiments, the electrostatic discharge system is adapted to deploy whenever desired by the user, including any number of specific predetermined conditions such as for example when the handbrake has been actuated. This embodiment is particularly suited—but restricted—to vehicles in which the brake cable is not easily accessible, and in particular where the brake cable is enclosed in a protective sheath or tubing.

In the present invention, the "handbrake system" of a vehicle is taken to refer to the permanent braking system of the vehicle, which is typically actuated when the vehicle has come to a permanent stop, for example when the vehicle is parked or waiting at traffic lights. Thus a "permanent stop" is defined herein as a stoppage of the vehicle such that a passenger may safely emerge from the vehicle, and is often associated with the engine being in a neutral gear and/or switched off. This is in contrast to a temporary stop, wherein only the footbrake system is used, and the engine is typically engaged with the first or other gear, enabling the vehicle may move at any time. (Although in some embodiments, such as the sixth embodiment, for example, the system of the present invention may be adapted to deploy responsive to operation of the footbrake only, this has limited advantages with respect to deployment that is responsive to operation of the handbrake, since occupants rarely leave the vehicle when the footbrake only is operated, and therefore there is little potential danger of discharging in such cases.) The handbrake system is commonly actuated via a hand actuated lever, but there are many examples of pedal-actuated variants. The term "handbrake" is used herein to include all manner of permanent braking systems, whether normally actuated via the hand or foot of the driver, and also includes servo-assisted systems.

The handbrake system of a vehicle typically comprises a mechanical linkage between the actuating lever which is operated by the user, and the brake pads at the wheels. This linkage is usually in the form of a metal cable that runs underneath the vehicle chassis from approximately the position of the driver to the rear axle, and therefrom to the wheels. When the driver actuates the handbrake to the "on" position, the cable is tugged in one longitudinal direction with respect to the chassis, and the brake pads clamp with respect to a disc or hub comprised on the wheels preventing rotation of the wheels. When the handbrake is released (the "off" position) the cable returns to its original position, releasing the brake pads and thus the wheels.

In some vehicles, the brake cable is exposed, and embodiments 1 through 5 are particularly adapted for mounting with respect to such an arrangement.

Figure 1B:
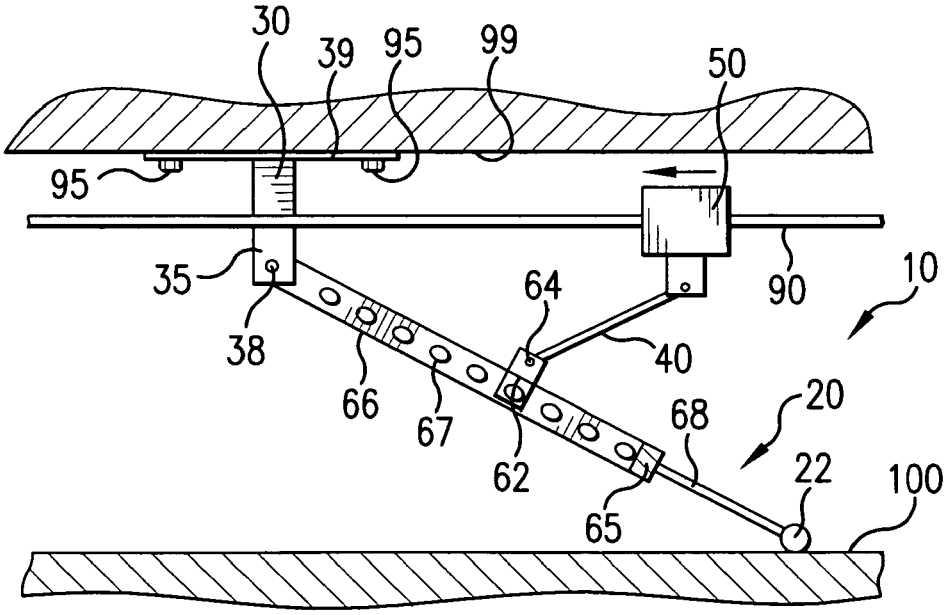

Referring to FIGS. 1(*a*) and 1(*b*), the system according to the first embodiment of the present invention, generally designated with the numeral (10), is in the form of a deployment device, associated with the brake cable (90) of the vehicle. The deployment device or system (10) comprises a conductor member or element (20) operatively connected to the brake cable (90) of the vehicle in a manner such that when the brake is in the "off" position (as illustrated in FIG. 1(*a*)), the conductor element (20) is in a retracted position and distanced from the road surface (100), and when the brake is actuated, i.e., in the "on" position, (as illustrated in FIG. 1(*b*)), the conductor element (20) is in a deployed position sufficient to make contact with the ground (100).

According to a first embodiment of the invention illustrated in FIGS. 1(*a*) and 1(*b*), the deployment device or system (10) comprises a bracket (30) that is fixable to the underside of the chassis (99) or any other suitable part of the vehicle in proximity to the brake cable (90). The bracket (30) comprises a base plate (39) having suitable bores via which the bracket (30) is bolted to the chassis (99) by means of bolts (95). The bracket (30) also comprises a downwardly depending member (35) at or near the free end of which the said conductor element (20) is pivotably mounted thereto by means of a pivot (38). The conductor element (20) comprises a free end (22) for contacting the ground when in the deployed position. A driving device (60) is provided in the form of a bracket (62) integrally formed or alternatively joined to or mounted onto the conductor element (20) and having a pivot (64). The bracket (62) is typically upwardly projecting and orthogonal to the conductor element (20).

The system (10) also comprises control means in the form of a suitable clamp (50) that is adapted for permanently clamping a user interface, in this embodiment the brake cable (90), so that the clamp (50) moves together with the cable (90). The clamp (50) is mechanically connected to the bracket (62) of the conductor element (20) via a pivoted link (40). The link (40) is a rigid member, so that when the brake cable moves to the position shown in FIG. 1(*b*), the conductor element (20) is pushed to the deployed position.

Figure 2A:
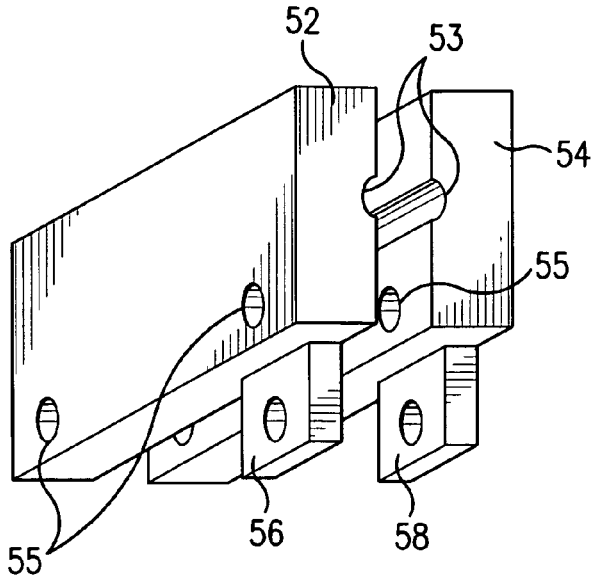
FIG. 2(*a*) illustrates the clamping means of the embodiment of FIG. 1(*a*) and 1(*b*) in exploded view.
Figure 2B:
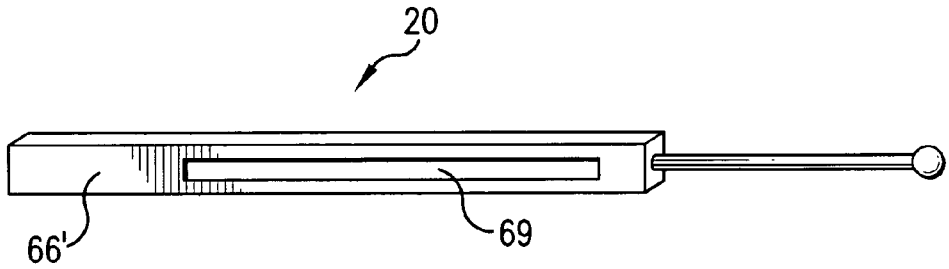
Figure 2C:
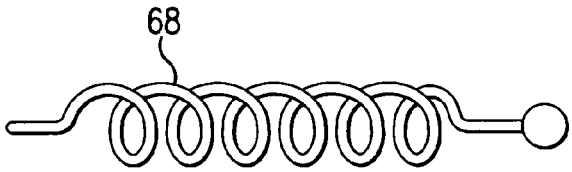

As illustrated in greater detail in FIG. 2(*a*), the clamp (50) typically comprises a left plate (52) and a right plate (54), each plate having a groove (53) and corresponding bores (55). When the plates are bolted together via the bores (55), the grooves (53) clamp tightly over the cable (90). Brake cables of different diameters may be clamped by the plates (52), (54), by simply adjusting the spacing between the plates as needed when these are clamped. Each plate (52), (54) of the clamp (50) further comprises a bracket (56), (58) respectively, and a suitable spigot may be passed through these brackets and one end of the member (40) enabling the latter to be pivotably mounted to the clamp (50).

The various components of the device (10), in particular the various dimensions and relative dispositions thereof, are thus designed and arranged with respect to the cable (90) so that when the brake cable (90) is in the deactivated or off mode (FIG. 1(*a*)), and thus the vehicle may be moving, the conductor element (20) is distanced from the ground and is prevented from rotating about the pivot (38) due to the mechanical constraints imposed by the link (40). As illustrated in FIG. 1(*b*), when the user activates the user interface, in this case the handbrake, the cable (90) is displaced to the left in this figure, and the clamp (50) pushes the link (40) in the same direction. This causes the driving means or bracket (62) to be urged in the same direction, which results in a rotating action being applied to the conductor element (20) about the pivot (38), wherein the first end (22) is displaced towards the ground (100), making contact therewith. The device (10) is preferably made from a conducting material, typically metal, and is mounted to the chassis in an electrically conducting manner. Alternatively, conducting means such as a wire or the like may be provided between the chassis at the bracket (30) and the conductor element (20). In either case, when the conductor element (20) is urged into contact with the ground, typically underneath the vehicle, any static electricity that has accumulated in the vehicle body is discharged to the ground. Similarly, any potential discharge between an exiting occupant and the vehicle body is minimized.

As illustrated in FIGS. 1(*a*) and 1(*b*), the conductor element (20) is preferably constructed from 2 parts. The upper part (66) is in the form of a rigid strut-like member, having a bore at one end thereof wherein to pivotably mount the same to the bracket (30). The upper part (66) further comprises a plurality of bores (67) along the length thereof. Each bore (67) is suitable for securing the bracket (62) thereto by means of a suitable bolt, thereby providing multiple alternative locations for the bracket (62). This enables the precise geometry and deployment characteristics of the device (10) to be adjusted to each particular vehicle onto which it is mounted. Alternatively, the bores (67) may be replaced with a slot (69), as illustrated in FIG. 2(*b*), and the bracket (62) is mountable at any position with respect to the slot (69) by means of a suitable nut and bolt arrangement, for example. The lower part (68) of the conductor element (20) is preferably a resilient rectilinear member and comprises end (22), which is preferably spherical in form to provide adequate ground contact area even when the device (10) is not perfectly aligned with the chassis (99) or ground (100). Alternatively, and as illustrated in FIG. 2(*c*), the lower part (68) may be in the form of a resilient helical member. The lower part (68) may be integral with the upper part (68), or alternatively suitably joined or mounted thereto, typically by fastening means (65). Preferably, the said lower part (68) is telescopically slidable with respect to the upper part (66) to further enable the device (10) to be adapted to optimize operation thereof with the specific vehicle onto which it is to be mounted.

Figure 3A:
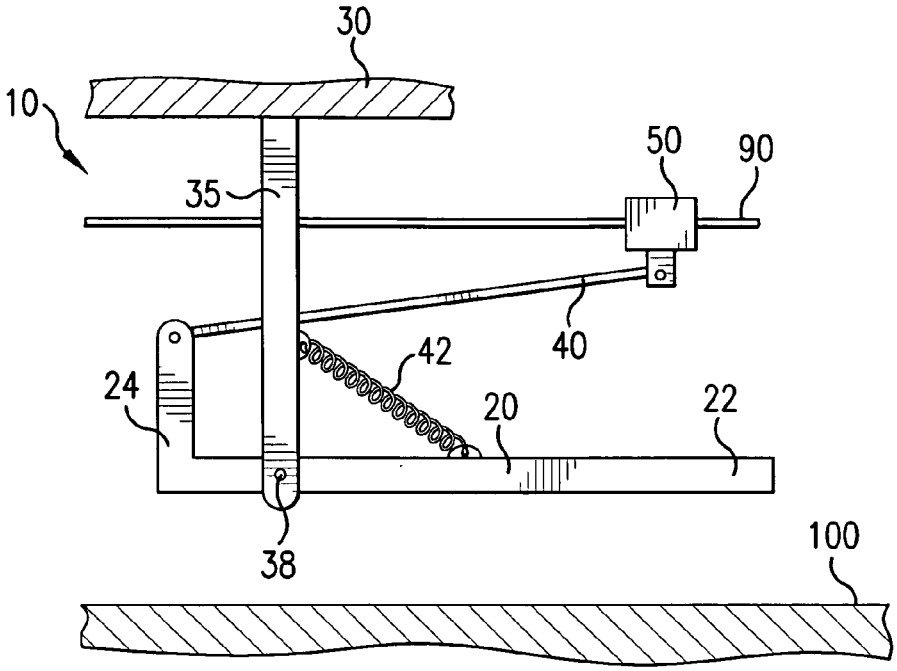
FIG. 3(*a*) and FIG. 3(*b*) illustrate schematically a second embodiment of the present invention in the retracted and deployed position, respectively.
Figure 3B:
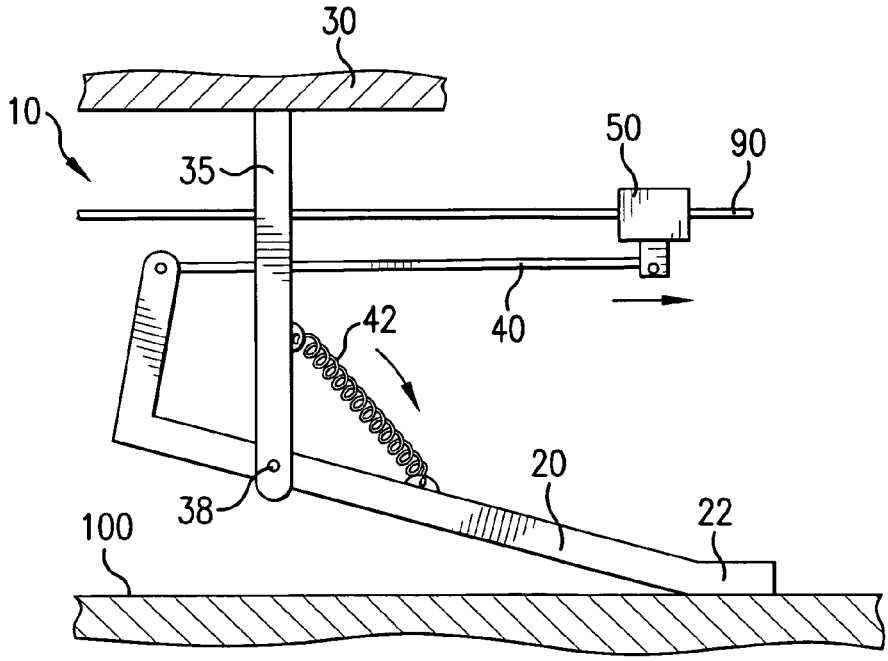

A second embodiment is illustrated in FIGS. 3(*a*) and 3(*b*), and comprises all the elements of the first embodiment as described above, mutatis mutandis, with the following differences. In this embodiment, the driving device is provided in the form of a second end (24) of the conductor element (20) on the opposite side of the pivot (38). The second end (24) is typically L-shaped having an upwardly extending part. The clamp (50) is mechanically connected to the second end (24) of the conductor element (20) via a pivoted link (40). The link (40) may be a rigid member, so that when the brake cable moves back to the position shown in FIG. 3(*a*), the conductor element (20) is retracted. Alternatively, the linkage may be non-rigid, for example a chain, cable or rope. In such a case in particular, but also optionally for the case where the link (40) is rigid, a spring (42) is provided between the conductor element (20) and the member (35) or bracket (30), such that when the conductor element (20) is deployed the spring is either pulled or compressed, storing potential energy. Thus, when the brake cable returns to the position illustrated in FIG. 3(*a*), the stored energy of the spring enables retraction of the conductor element (20). As illustrated in FIG. 3(*b*), when the user activates the user interface, in this case the handbrake, the cable (90) is displaced to the right in this figure, and the clamp (50) pulls the link (40) in the same direction. This causes the driving means or second end (24) to be urged in the same direction, which results in a rotating action being applied to the conductor element about the pivot (38), wherein the first end (22) is displaced towards the ground, making contact therewith.

Figure 4A:
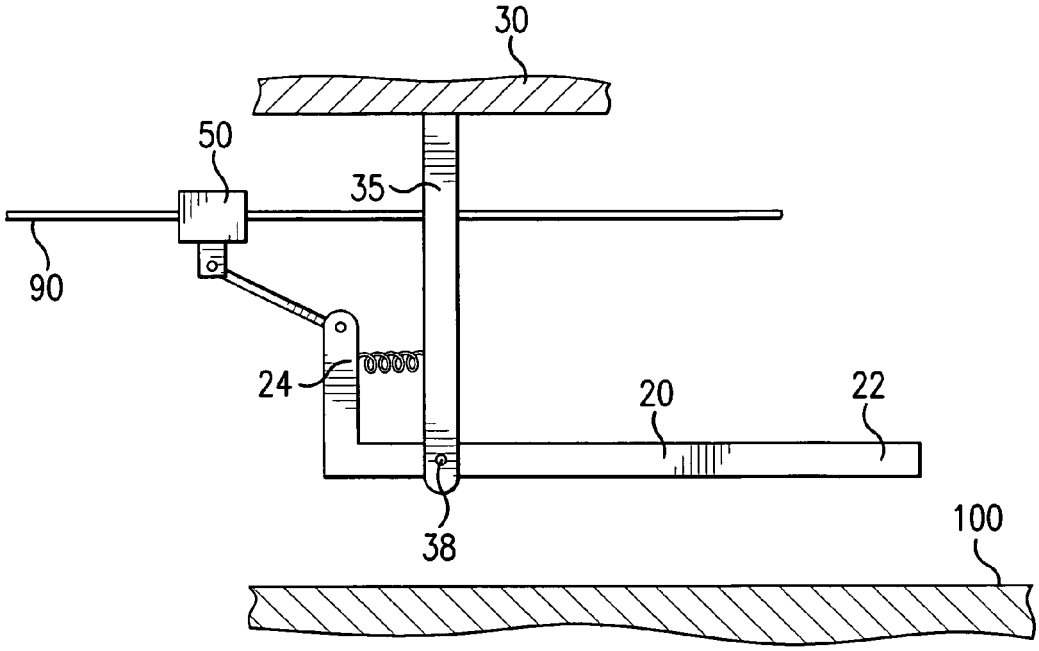
FIG. 4(*a*) and FIG. 4(*b*) illustrate schematically a third embodiment of the present invention in the retracted and deployed position, respectively.
Figure 4B:
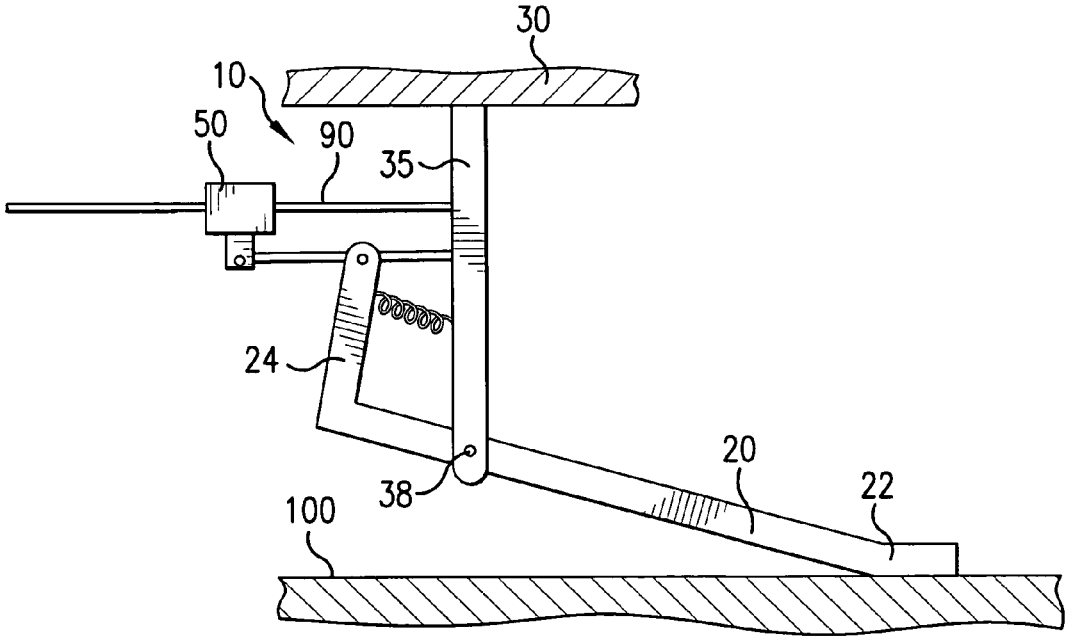

A third embodiment is illustrated in FIGS. 4(*a*) and 4(*b*), and comprises all the elements of the second embodiment as described above, mutatis mutandis, with the following differences. In this embodiment, the clamp (50) is arranged on the cable (90) such that when the hand brake is actuated, the link (40) is pushed towards the second end (24), rather than away therefrom, so as to rotate the first end (22) towards the ground.

Figure 5A:
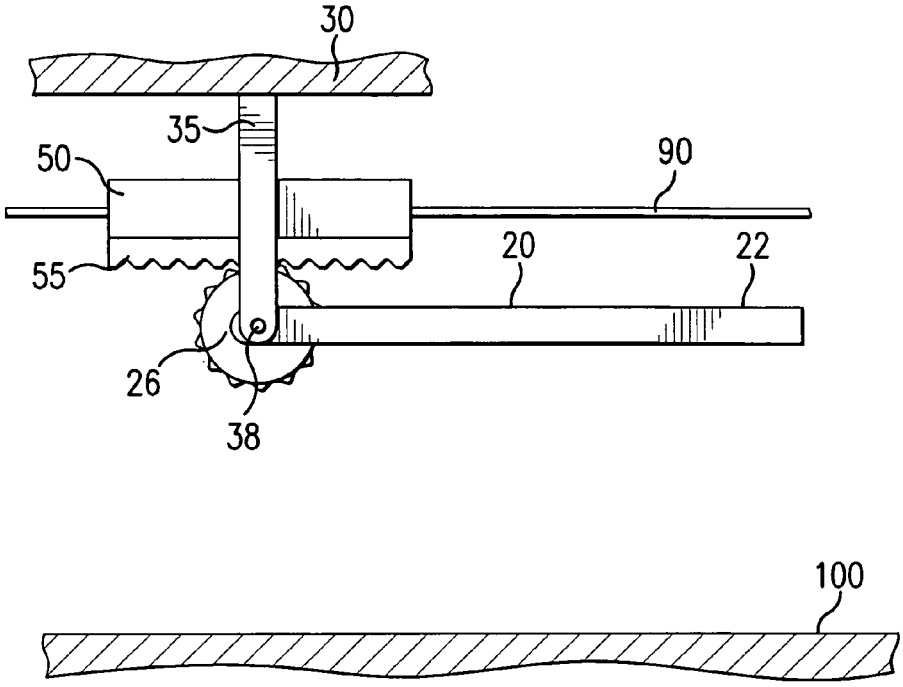
FIG. 5(*a*) and FIG. 5(*b*) illustrate schematically a fourth embodiment of the present invention in the retracted and deployed position, respectively.
Figure 5B:
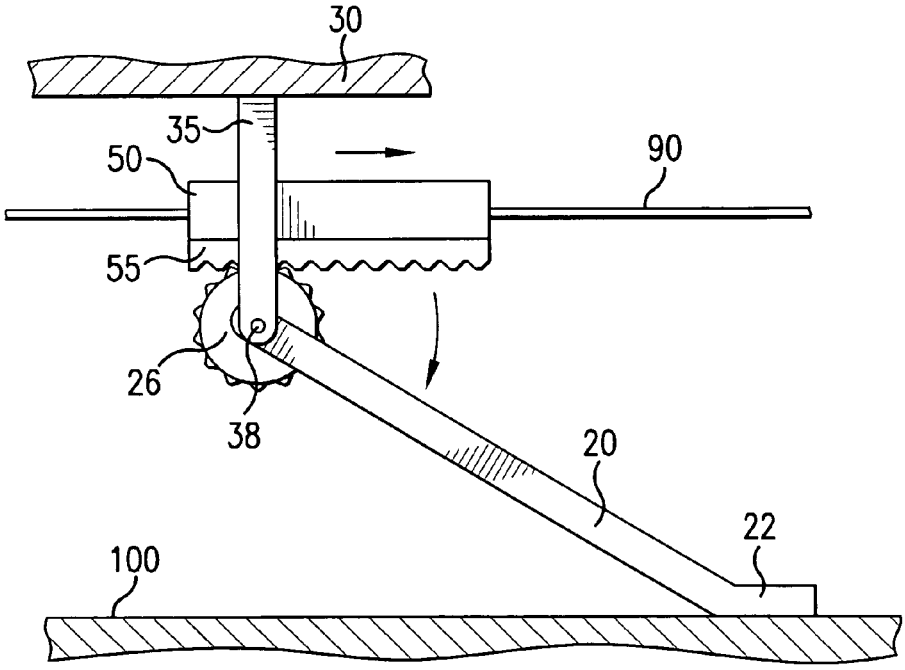

A fourth embodiment is illustrated in FIGS. 5(*a*) and 5(*b*), and comprises all the elements of the first through third embodiments as described above, mutatis mutandis, with the following differences. Referring to FIGS. 5(*a*) and 5(*b*) the deployment device according to the invention differs from that of the first through third embodiments in that the driving means comprises a rack and pinion arrangement. Thus, the second end of the conductor element (20) now comprises a toothed wheel or pinion (26) rigidly connected to the conductor element (20) and pivotable about its center via pivot (38). A complementary rack (55) having linearly disposed teeth complementary to those on the wheel (26) is rigidly connected to the clamp (50), integrally or otherwise, and such as to engage with wheel (26). As the brake cable (90) moves to the right in FIGS. 5(*a*) and 5(*b*) during actuation of the handbrake, the rack (55) provides rotation to wheel (26) in a clockwise direction, thereby lowering the first end (22) the ground. Conversely, when the cable (90) is displaced in the opposite direction, the wheel (26) is rotated anti-clockwise, enabling stowage of the conductor element (20). Optionally, suitable gears may be provided to amplify or reduce the amount of turning of the conductor element with respect to the displacement of the cable (90), such that at maximum displacement of the cable (90), the first end (22) just makes contact with the ground.

Figure 6:
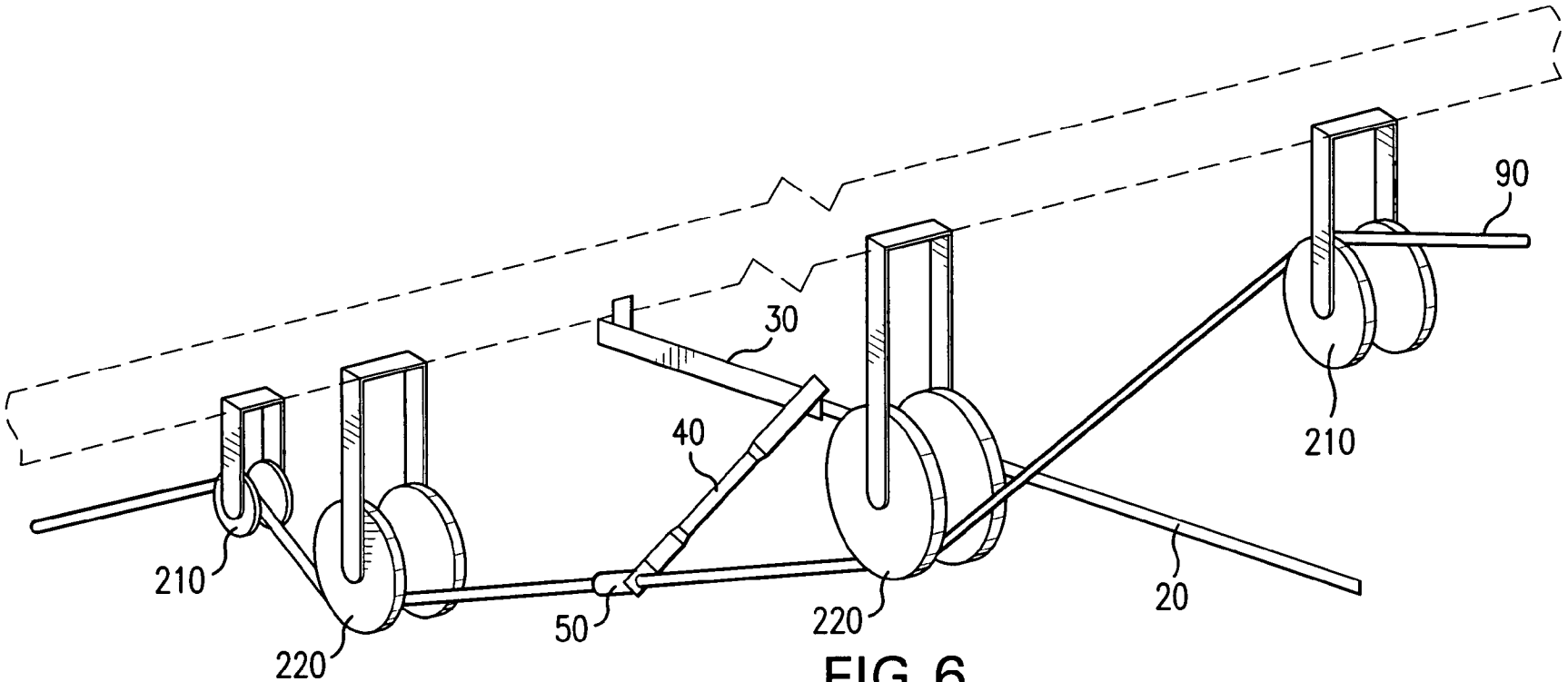
FIG. 6 illustrates schematically a fifth embodiment of the present invention in the retracted and deployed position, respectively.

A fifth embodiment is illustrated in FIG. 6, and comprises all the elements of the first embodiment as described above, mutatis mutandis, with the following differences. In this embodiment, a displacement mechanism (200) comprising a series of pulleys arranged linearly is provided for displacing the cable (90) in a downward direction towards the ground (100) in the vicinity of the device (10). The displacement mechanism (300) comprises a pair of large diameter pulleys (310) flanked on either side by one small diameter pulley (320), so that the all the pulleys are substantially co-planar. The cable (90) is then threaded through the pulleys as illustrated in FIG. 6, i.e., via the upper facing edges of the small pulleys (320) and the lower facing edges of the large pulleys (310), This arrangement amplifies the effect of the displacement of the clamp (50) due to the movement of the brake cable (90), since the angle between the strut (40) and the conductor element (20) is less shallow. This embodiment is particularly advantageous in vehicles in which the bottom of the chassis is high off the ground.

Figure 7A:
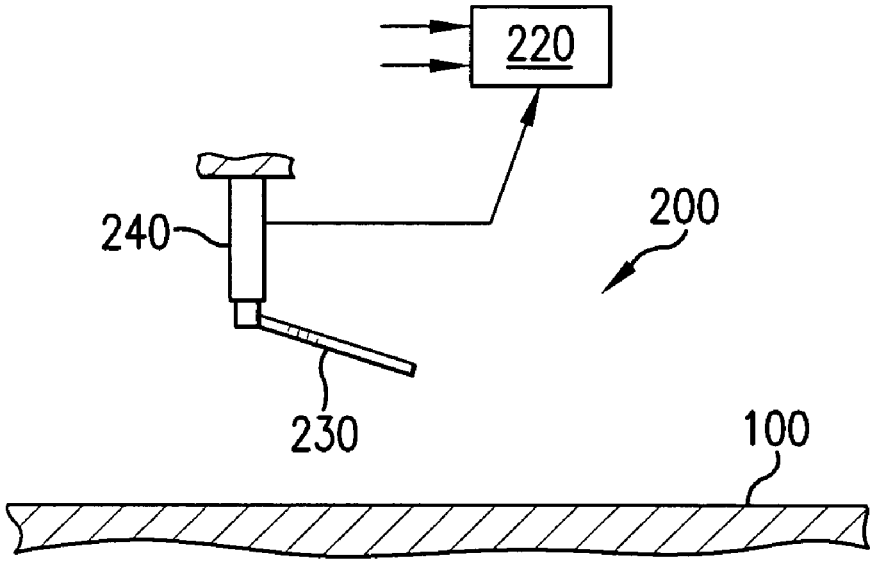
FIG. 7(*a*) and FIG. 7(*b*) illustrate schematically a sixth embodiment of the present invention in the retracted and deployed position, respectively.
Figure 7B:
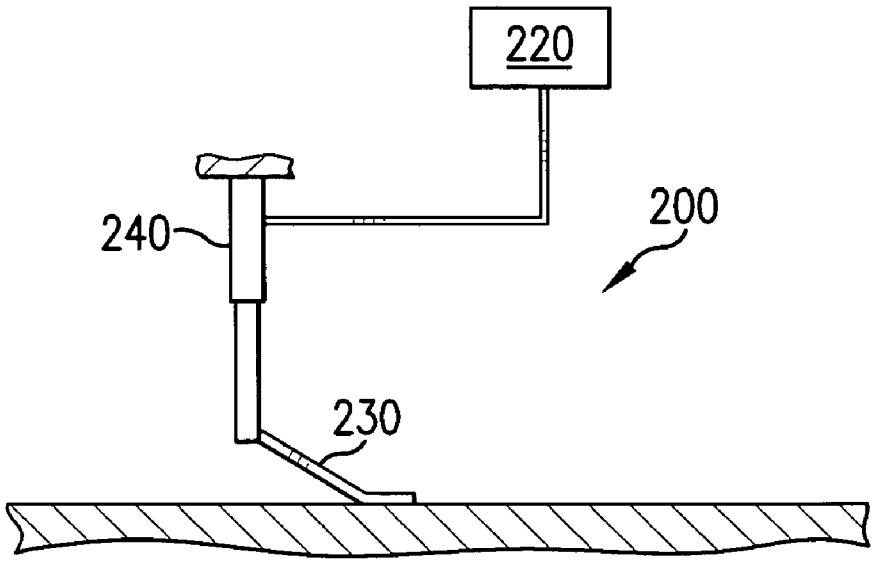

A sixth embodiment of the present invention is illustrated in FIGS. 7(*a*) and 7(*b*). According to this embodiment, the system, generally designated herein by the numeral (200), is particularly suitable for vehicles in which the brake cable is not exposed or readily accessible from outside the chassis, but may also be used, nevertheless, with vehicles in which the cable is exposed. In fact, the system (200) according to the sixth embodiment (and also according to the seventh embodiment) does not depend on whether or not there is a brake cable. Thus, these embodiments are also suitable in vehicles in which the brake cable is replaced by other means of transmitting the command from the driver to actuate or release the brake. For example, an electrical cable, fiber optic cable or any other medium, including any wireless system such as microwave, ultrasonic, infrared and so may be used to transmit the command by the driver to the brake system to engage or disengage the brakes, and the system (200) is adapted for deploying or stowing the conductor responsive to this command or signal.

According to the sixth embodiment, the system (200) comprises a suitable control means (220) operatively connected to a suitable actuating means (240). Such actuating means (240) comprises or is operatively connected to a conductor element (230), and is configured to selectively deploy or retract the conductor element (230) according to the operating signal provided by the control means (220). Thus, the actuating means (240) may be similar to those described with respect to the first through fifth embodiments and further comprise power driven means for enabling deployment and retraction of the conductor element (230) to provide the motion thereto that was previously provided by means of the brake cable of the first through fifth embodiments. Alternatively, for example, the actuating means (240) may be based on a pneumatic, hydraulic or electrical motorised system that selectively extends or retracts a pneumatically, hydraulically or electrically driven jack, respectively, which carries the conductor element (230) towards and away from the ground, as required, in response to signals provided by the control means (220). The control means (220) provide appropriate signals to the actuating means (240) when desired by the user, and may comprise a simple switch arrangement which can be switched on or off by the user, typically the driver of the vehicle. Alternatively, the control means (220) may be controlled by a suitable computer (not shown) so as to actuate the actuating means in any one of a plurality of conditions. For example, the computer may be operatively connected to motion sensors, and when it is sensed that the vehicle has stopped, for example, the computer sends the appropriate signal to the actuating means (240) for deploying the conductor element (230). The control means (220) may provide the appropriate signal by electric or fiber optic cable, or by any suitable medium or wireless means.

Additionally or alternatively, the computer may be operatively connected to a sensor (not shown) that senses the accumulated charge on the vehicle, and provides the grounding when a predetermined threshold is crossed. Additionally or alternatively, the control means (220) may comprise a timer, and deploy the conductor element (230) at preset and regular intervals, or at any other desired timed sequence.

Figure 8:
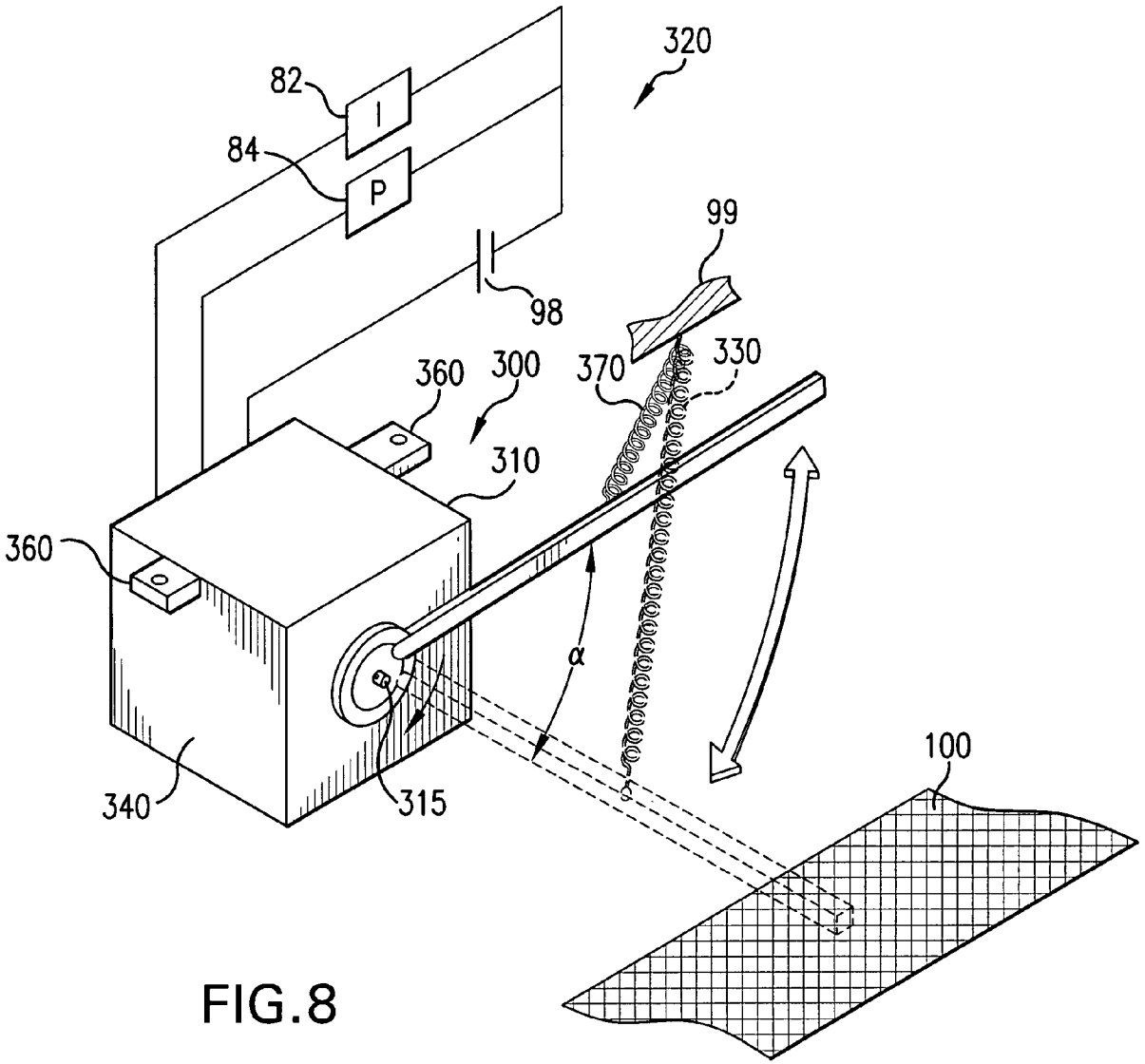
FIG. 8 illustrates schematically a seventh embodiment of the present invention in the retracted and deployed position.

A seventh and preferred embodiment is illustrated in FIG. 8, and comprises all the elements of the sixth embodiment as described above, mutatis mutandis, with the following differences. In this embodiment, the system (300) is in the form of a device connected to the user interface via suitable circuitry or the like, and comprises a suitable housing (310) accommodating an actuating means (340) in the form of an electric motor having a shaft (315) that projects from the housing and to which the conductor (330) is mounted for rotation therewith. Preferably, the motor is a stepper motor, or is otherwise configured, electrically, electronically, mechanically or by any other suitable means, for selectively and reversibly rotating the shaft (315) through a predetermined arc $\alpha$, from a retracted position shown in this figure to a deployed position, shown in phantom lines, and back to the retracted position.

The housing (310) comprises brackets (360) or any other suitable mounting means for mounting the device (300) to the underside of the chassis of the vehicle. Preferably, conducting means such as a wire (370) or the like may be provided between the chassis (99) near the housing (300), and electrically connected to the conductor element (330). Such a wire (370) needs to be able to accommodate the changes in geometry associated with the conductor (330) rotating between the retracted and deployed positions. In either case, when the conductor element (330) is urged into contact with the ground (100), typically underneath the vehicle, any static electricity that has accumulated in the vehicle body is discharged to the ground. Similarly, any potential discharge between an exiting occupant and the vehicle body is minimized.

As with other embodiments, the conductor element (330) itself may be extendable to take account of different heights in vehicles between the chassis and the ground, and/or the magnitude of the arc α may also be adjusted to suit the particular geometrical constraints of the vehicle. Similarly, the conductor element (330) may be resilient, and of any suitable shape including rectilinear, curvilinear, helical and so on, some of which have been described in greater detail with respect to other embodiments, mutatis mutandis.

The device is electrically connected to the vehicle's battery (98), or alternatively to any other suitable power source, including, for example, an independent battery. Preferably, the control means (320) are in the form of a suitable operating circuit, connecting the motor and the battery (98) to the user interface, for example the hand brake indicator light circuit (82) and (particularly in vehicles fitted with automatic transmission) also the parking indicator light circuit (84).

Thus, in response to interaction of the user, typically the driver, with the user interface, when the vehicle is parked and/or the hand brake is actuated, so that the parking indicator light and/or the hand brake indicator light is switched on in the dashboard, the electrical circuit to the motor or actuating means (340) is completed, and the motor rotates the shaft (315) by arc α such that conductor element (330) is rotated to the deployed position. Suitable electrical, electronic, mechanical or other means are provided to ensure that the conductor means (330) does not overshoot the desired arc α. For example, a sensor may be provided for sensing when the conductor element (330) is in contact with the ground, for example by sensing resistance to turning of the shaft (315), and this sends an appropriate signal to the actuating means (340) to discontinue turning the shaft (315).

Similarly, suitable electronic, mechanical or other means are provided for actuating the motor to rotate the shaft (315) in the reverse direction when both the parking light circuit and the hand brake circuit are inactivated, but when the electrical system of the vehicle is otherwise switched on, which signals that the vehicle is now moving. Suitable electronic, mechanical or other means are preferably provided to discriminate between this condition and the condition when the engine and electrical systems of the vehicle are switched off, that is after the vehicle is parked and the driver is about to exit the vehicle, wherein it is preferable for the conductor element (330) to remain deployed and in contact with the ground.

Additionally or alternatively, the control means (320) are in the form of a suitable operating circuit, connecting the motor and the battery (98) to any suitable circuit associated with the hand brake and/or to the parking setting of the automatic transmission of the vehicle, such that when the handbrake is actuated, and/or the transmission set to parking mode, a suitable signal is transmitted to the actuating means (340), as before.

Additionally or alternatively, the control means (320) may comprise a microswitch or the like connected to the brake lever, so that when the brake lever is actuated, the control means (320) sends an appropriate signal to the actuation means (340) to deploy the conductor element (330), and when the brake lever is released, another signal is sent to, or the lack of the first signal is sensed by, the actuation means (340), which then retracts the conductor element (330).

Additionally or alternatively, and as in the sixth embodiment, the control means (320) may be configured to provide appropriate signals to the actuating means (340) when desired by the user, and may comprise, for example, a simple switch arrangement which can be switched on or off by the user, typically the driver of the vehicle. Additionally or alternatively, the control means (320) may be controlled by a suitable computer (not shown) so as to actuate the actuating means in any one of a plurality of conditions. For example, the computer may be operatively connected to motion sensors, and when it is sensed that the vehicle has stopped, for example, the computer sends the appropriate signal to the actuating means (340) for deploying the conductor element (330). The control means (320) may provide the appropriate signal by electric or fiber optic cable, or by any suitable medium or wireless means. Additionally or alternatively, the computer may be operatively connected to a sensor (not shown) that senses the accumulated charge on the vehicle, and provides the grounding when a predetermined threshold is crossed. Additionally or alternatively, the control means (320) may comprise a timer, and deploy and retract the conductor element (330) at preset and/or regular intervals, or at any other desired timed sequence.

According to the present invention, a method is also provided for discharging static electricity from a vehicle comprising the step of providing a selectively retractable (or stowable) and deployable electrical conductor in electrical contact with the vehicle body. When it is desired to provide a ground path for the vehicle, the conductor is deployed such as to contact the ground, and when it is desired to stop such contact, the conductor is retracted. In the preferred embodiment, the step of providing a ground path for the vehicle is advantageously associated with operation of the handbrake system of the vehicle.

While in the foregoing description describes in detail only a few specific embodiments of the invention, it will be understood by those skilled in the art that the invention is not limited thereto and that other variations in form and details may be possible without departing from the scope and spirit of the invention herein disclosed or exceeding the scope of the claims.

The invention claimed is:

1. An electrostatic discharge system for a road vehicle comprising:

at least one electrically conducting conductor element in electrical contact with an electrically conducting part of the vehicle body;

actuation means mountable to said vehicle, said actuation means adapted for selectively and reversibly moving said conductor element between a deployed position and a retracted position, wherein in said deployed position said conductor element is in contact with the ground such as to provide an electrical pathway for electric charge from said electrically conducting part of the vehicle body to the ground, and wherein in said retracted position said conductor element is distanced from the ground such as to interrupt said electrical pathway; and control means operatively connected to said actuation means and to a user interface, adapted for controlling operation of said actuation means responsive to an interaction with said user interface, wherein said actuation means are powered by suitable power means including an electrical motor.

2. A system as claimed in claim 1, wherein said power means comprises an electrical stepper motor.

3. A system as claimed in claim 1, wherein said motor comprises a shaft connected to said conductor element and wherein said shaft is capable of selectively and reversibly rotating the shaft through a predetermined arc α, from said retracted position said deployed position, and back to the retracted position.

4. A system as claimed in claim 1, wherein said motor is connected to a suitable electrical power source and said user interface via a suitable circuit.

5. A system as claimed in claim 4, wherein said interface comprises the brake light circuit of said vehicle.

6. A system as claimed in claim 5, wherein selective completion or braking of said brake light circuit, responsive to an interaction by user comprising actuation or release of the brake, reversibly deploys or retracts said conductor element.

7. A system as claimed in claim 4, wherein said interface comprises the parking light circuit of said vehicle.

8. A system as claimed in claim 7, wherein selective completion or braking of said parking light circuit, responsive to an interaction by user comprising actuation or release of the parking mode of the gearbox of the vehicle, reversibly deploys or retracts said conductor element.

9. A system as claimed in claim 4, wherein said interface comprises a suitable switch actuable by a user in the vehicle.

10. A system as claimed in claim 9, wherein selective completion or braking of a switch light circuit of said switch, responsive to an interaction by user comprising actuation or inactivation of said switch, reversibly deploys or retracts said conductor element.

11. A system as claimed in claim 1, wherein said actuating means comprises a suitable housing mountable to an underside of said vehicle.

12. A system as claimed in claim 1, further comprising an electrical conductor fixed to said electrically conducting part of said vehicle and to said conductor element.

13. A system as claimed in claim 3, wherein said conductor element comprises an upper part pivotably mounted to said shaft and a lower part comprising a free end.

14. A system as claimed in claim 13, wherein said lower part is telescopically slidable with respect to said upper part for adjusting a longitudinal length of said conductor element.

15. A system as claimed in claim 13, wherein said free end is in spherical form.

16. A system as claimed in claim 13, wherein said lower part is in substantially rectilinear form.

17. A system as claimed in claim 13, wherein said lower part is in substantially helical form.

18. An electrostatic discharge system for a road vehicle comprising:

at least one electrically conducting conductor element in electrical contact with an electrically conducting part of the vehicle body;

actuation means mountable to said vehicle, said actuation means adapted for selectively and reversibly moving said conductor element between a deployed position and a retracted position, wherein in said deployed position said conductor element is in contact with the ground such as to provide an electrical pathway for electric charge from said electrically conducting part of the vehicle body to the ground, and wherein in said retracted position said conductor element is distanced from the ground such as to interrupt said electrical pathway; and control means operatively connected to said actuation means and to a user interface, adapted for controlling operation of said actuation means responsive to an interaction with said user interface, wherein said user interface comprises a suitable computer programmed to provide suitable deployment and retracting signals to said control means according to predetermined conditions, and wherein said control means comprise suitable power means for powering a driving means according to signals received from said computer.

19. A system as claimed in claim 18 further comprising a motion sensor operatively connected to said computer, and wherein said computer is programmed to provide appropriate deployment signal to said actuation means when said motion sensors sense an absence of motion by the vehicle.

20. A method for discharging static electricity from a vehicle comprising:

(a) providing a selectively retractable and deployable electrical conductor in electrical contact with the vehicle body;

(b) when it is desired to provide a ground path for the vehicle, deploying the conductor such as to contact the ground;

(c) when it is desired to stop such contact, retracting the conductor, wherein the step of providing a ground path for the vehicle is advantageously associated with operation of the handbrake system of the vehicle.

* * * * *